US007175908B2

(12) United States Patent
Connolly, Jr.

(10) Patent No.: US 7,175,908 B2
(45) Date of Patent: Feb. 13, 2007

(54) HIGH TEMPERATURE SEARCH LINE

(76) Inventor: Thomas J. Connolly, Jr., 326 Rumford Rd., Lititz, PA (US) 17543

( * ) Notice: Subject to any disclaimer, the term of this patent is extended or adjusted under 35 U.S.C. 154(b) by 151 days.

(21) Appl. No.: 10/877,399

(22) Filed: Jun. 25, 2004

(65) Prior Publication Data

US 2004/0265582 A1 Dec. 30, 2004

Related U.S. Application Data

(60) Provisional application No. 60/484,263, filed on Jun. 30, 2003.

(51) Int. Cl.
*D02G 3/00* (2006.01)
*D02G 3/36* (2006.01)

(52) U.S. Cl. ..... 428/378; 428/372; 428/375; 428/377; 57/210; 57/211; 57/229; 57/237; 57/240; 87/1; 87/7; 87/8; 87/9

(58) Field of Classification Search ..... 57/210, 57/211, 230, 237, 240, 241, 229; 87/1, 5, 87/7, 8, 9; 428/364, 375, 378, 367, 379, 428/372, 377
See application file for complete search history.

(56) References Cited

U.S. PATENT DOCUMENTS 2,583,855 A * 1/1952 Kenis ..... 442/60
3,911,785 A * 10/1975 Hood ..... 87/1
3,932,697 A * 1/1976 Hood ..... 174/79
4,019,940 A * 4/1977 Hood ..... 156/148
4,034,547 A * 7/1977 Loos ..... 57/211
4,321,854 A * 3/1982 Foote et al. ..... 87/6
4,534,262 A * 8/1985 Swenson ..... 87/6
4,886,691 A * 12/1989 Wincklhofer ..... 428/68
5,022,780 A * 6/1991 Shaw ..... 403/275
5,119,512 A * 6/1992 Dunbar et al. ..... 2/167
5,136,755 A * 8/1992 Shaw ..... 24/122.6
5,970,517 A * 10/1999 Jordan ..... 2/69
2003/0037529 A1* 2/2003 Hanna et al. ..... 57/7
2005/0229770 A1* 10/2005 Smeets et al. ..... 87/8

FOREIGN PATENT DOCUMENTS

FR 2473501 A * 7/1981

* cited by examiner

*Primary Examiner*—Jill Gray
(74) *Attorney, Agent, or Firm*—Synnestvedt & Lechner LLP

(57) ABSTRACT

A fire safety line is disclosed having a core of heat-resistant strands twisted together and surround by a tough, cut and abrasion resistant jacket. Preferably, the strands of the core are glass fibers coated with vermiculite and the jacket is formed of braided glass fibers encapsulated by a para-aramid. Stainless steel wire may also be interbraided to reinforce the jacket.

18 Claims, 1 Drawing Sheet

FIG.1
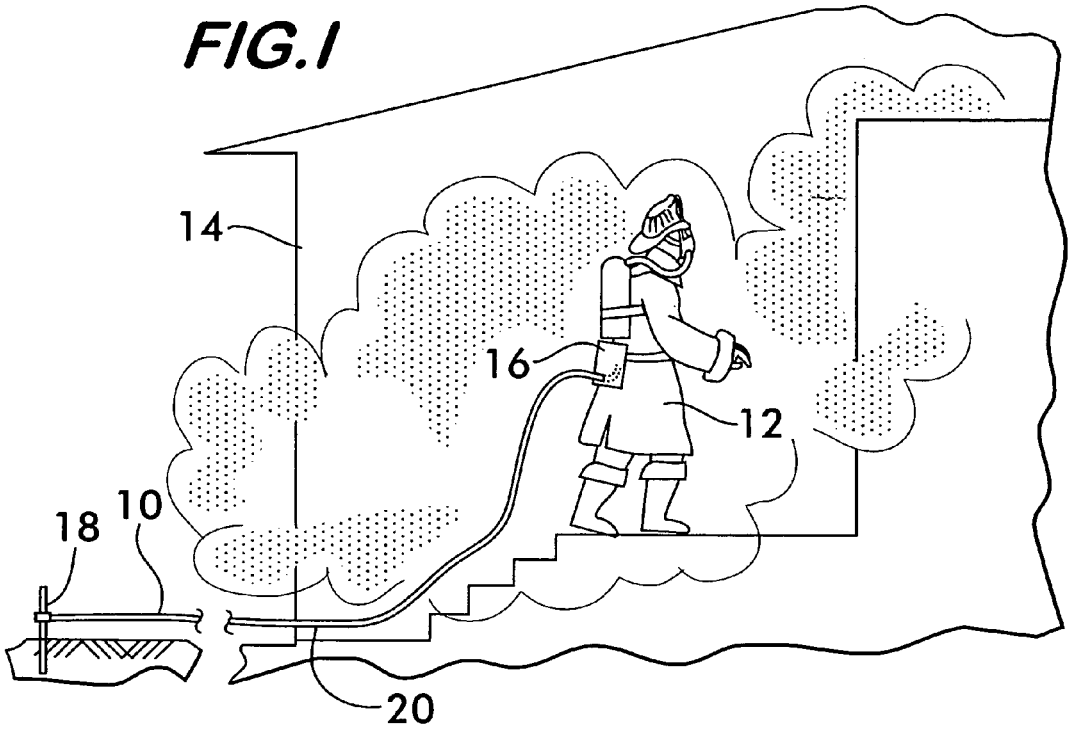
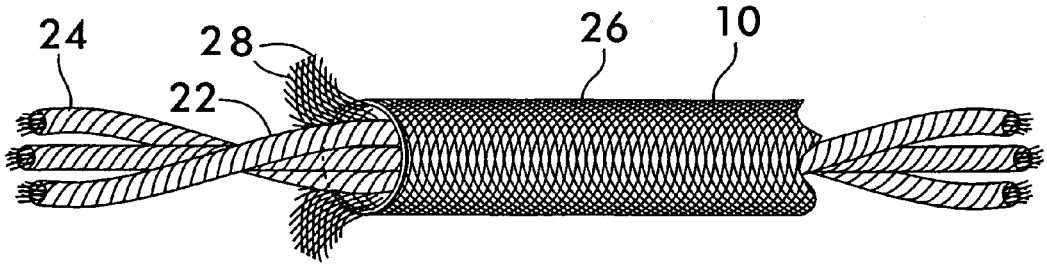
FIG.2

HIGH TEMPERATURE SEARCH LINE

CROSS-REFERENCE TO RELATED APPLICATION

This application is based upon and claims priority to U.S. Provisional Application No. 60/484,263, filed Jun. 30, 2003.

FIELD OF THE INVENTION

The invention relates to a search line used to define a path through a hazardous environment such as a burning building and especially to search lines capable of withstanding high temperature conditions.

BACKGROUND OF THE INVENTION

According to statistics compiled since 1990 by the National Fire Protection Association, one third of firefighters who died of smoke inhalation while fighting a fire within a burning building perished because they became lost within the building and their breathing apparatus ran out of air before they could find their way back out. The loss of situational awareness by firefighters within a burning building, even among the most experienced firefighters with the best training, is likely unavoidable in view of the extremely dangerous environment of intense heat and flames, blinding smoke and falling debris encountered while fighting a fire and effecting rescue of persons trapped in a burning building.

This problem of firefighters becoming lost within burning structures such as buildings, aircraft, ships, oil platforms and the like has been addressed in the past by the use of search lines which are carried by the firefighter into the burning structure. One end of the line is secured outside of the entrance to the structure, the other end remains secured to the firefighter and is payed out as he or she moves through the structure. The line allows the firefighter to find the way back to safety through the maze of burning debris and flames despite the blinding smoke within the structure. The line also allows other firefighters to locate comrades who may be injured or trapped by debris and unable to move from a deteriorating situation. The line may also be used to find the remains of firefighters killed in the line of duty.

Search lines are, thus, seen to be a vital piece of safety equipment and, if used, could prevent a substantial number of deaths in fighting fires. To be effective, search lines should be able to withstand the intense heat of a building fire while remaining strong and flexible so as to remain intact and lead the firefighter back to safety. The search line should also be resistant to cuts and abrasions occasioned by falling debris within the burning structure as well as by friction between the line and parts of the structure around which the line may be bent or drawn.

SUMMARY OF THE INVENTION

The invention concerns a flexible, elongated line usable to define a path through a region of intense heat. The line comprises a continuous, flexible, non-flammable inner core and an outer abrasion and cut resistant jacket substantially surrounding the inner core.

Preferably, the jacket comprises a plurality of filamentary members interlaced into a tubular form defining a central space for receiving the core. The filamentary members are interlaced by braiding, although knitting, weaving and spinning are also feasible. The filamentary members forming the jacket preferably comprise continuous filament glass fibers encapsulated by a para-aramid.

Preferably, the core comprises a plurality of continuous filament strands twisted together. The strands comprise glass fibers coated with vermiculite. Three strands are preferred.

BRIEF DESCRIPTION OF THE DRAWINGS

FIG. 1 illustrates the use of the search line according to the invention; and FIG. 2 is a partially exploded view showing the construction of the search line.

DETAILED DESCRIPTION OF THE PRESENTLY PREFERRED EMBODIMENTS

FIG. 1 illustrates a search line 10 according to the invention being used by a firefighter 12 within a burning structure 14. The bulk of the length of line 10 is initially held within a bag 16 worn by the firefighter 12. One end 18 of the line 10 is secured outside of the structure 14 and the line is payed out from the bag 16 as the firefighter moves through the burning structure 14. The line 10 defines a path 20 through the burning structure 14 which the firefighter 12 can follow back out of the structure to safety despite the smoke and flames which obscure his vision within the structure.

FIG. 2 shows the construction of a preferred embodiment of the line 10 according to the invention. Line 10 comprises a flexible, continuous inner core 22, preferably formed from a plurality of heat resistant continuous filament strands 24 twisted together to provide both flexibility and strength in the manner of a rope. The strands comprise continuous multifilament E-glass yarns coated with vermiculite. The vermiculite coating is applied by passing the twisted strands 24 through a liquid bath containing the vermiculite in solution. Preferably, the vermiculite comprises between 2 wt % and 20 wt % of the strands to provide effective heat resistance characteristics as described below. Alternately, the strands 24 may comprise heat resistant multifilament carbon fibers or ceramic fibers, as well as non-continuous filament glass fibers.

An outer jacket 26 substantially surrounds the inner core 22. Jacket 26 is preferably formed of interlaced filamentary members 28 having relatively high tensile strength and excellent toughness for resistance to cuts and abrasion. Filamentary members 28 preferably comprise continuous multifilament glass fiber yarns of E-glass encapsulated by a para-aramid layer. Para-aramids are long-chain synthetic polyamides and are better known by their brand names such as Kevlar, Kevlar 29, Kevlar 49, Twaron and Aramica to cite a few examples. The para-aramid layer, preferably Kevlar or a combination of Kevlar and Twaron for strength and fire resistance is applied over the glass fibers in a spinning process. Preferred formulations of glass fiber and para-aramid range between about 46 wt % glass to about 66 wt % glass to provide the desired abrasion and cut resistance to the jacket 26. The glass fiber provides the jacket 26 with some resistance to heat while the para-aramid encapsulation provides the characteristics of strength, toughness and abrasion-resistance allowing the jacket 26 to protect the strands 24 from abrasion and cuts. Alternatively the jacket 26 may comprise fire-resistant cotton, nylon filaments for strength and toughness, as well as stainless steel wire to provide strength, abrasion resistance and heat resistance. The stainless steel wire may be advantageously interlaced with the aforementioned para-aramid encapsulated glass filaments for increased toughness and strength. Meta-aramids such as Nomex and Conex are also feasible for encapsulating the filamentary members comprising the jacket.

The filamentary members 28 comprising jacket 26 are preferably interlaced by braiding, although knitting, weaving and spinning are also feasible. Braiding is preferred because it provides the line with handling, draping, coiling and flexibility characteristics similar to ropes and other lines which firefighters are used to. Braiding of the jacket 26 also allows the line 10 to be manufactured using traditional rope making machinery, wherein the filamentary members 28 are braided over the core 22 in a substantially continuous process as the strands 24 comprising core 22 are fed through the braiding machine.

The search line 10 according to the invention has undergone extensive testing which has revealed excellent properties allowing the line 10 to be used in the harshest conditions. The line has an ultimate tensile strength of 650 psi. While the jacket 26 contributes to the ultimate strength, it is the core 22 which provides the bulk of the strength to the line 10 as well as the dominant fire resistant properties.

The preferred embodiment of the line 10 is rated at 1200° F. continuous service. The core has a melting point of 2080° F. and does not support combustion. Simulator testing has shown that the line 10 will survive severe fire conditions including exposure to direct flame, radiant heat and contact with burning and hot debris as well as multiple flashovers (rapid fire progress including backdrafts and fire gas ignitions) and still maintain its strength and flexibility. In a particularly intense fire situation, the outer jacket 26 may char or burn away but the core 22 remains intact up to temperatures approaching its melting point of 2080° F.

Preferably, line 10 has a diameter between 0.25 and 0.375 inches allowing it to be easily picked-up by a gloved hand and yet be compact and light enough so that a practical length may be easily carried by a firefighter into the burning structure.

Use of the search line 10 according to the invention will give firefighters an increased safety advantage. Secure in the knowledge that the search line 10 will survive extreme fire conditions and remain intact to bring them out to safety, the firefighters will be able to enter a burning structure with more confidence of survival, and thus, the search line according to the invention will contribute to saving lives of both firefighters and those whom they are rescuing.

What is claimed is:

1. A flexible, elongated line usable to define a path through a region of intense heat, said line comprising a continuous, flexible, non-flammable inner core formed of a plurality of glass fiber strands coated with vermiculite, said strands being twisted together, and an outer abrasion and cut resistant jacket substantially surrounding said inner core.

2. A line according to claim 1, wherein said jacket comprises a plurality of filamentary members interlaced into a tubular form defining a central space for receiving said core.

3. A line according to claim 2, wherein said filamentary members are interlaced by braiding.

4. A line according to claim 2, wherein said filamentary members comprise para-aramid fibers.

5. A line according to claim 4, wherein said filamentary members further comprise glass fibers.

6. A line according to claim 2, wherein said filamentary members comprise glass fibers over which para-aramid fibers are spun.

7. A line according to claim 6, wherein said filamentary members comprise between about 46 wt % and about 66 wt % glass fiber.

8. A line according to claim 2, wherein said filamentary members include nylon filaments.

9. A line according to claim 2, wherein said filamentary members include stainless steel.

10. A line according to claim 1, wherein said vermiculite comprises between 2 wt % and about 20 wt % of said strands.

11. A line according to claim 1, wherein said glass fiber strands comprise E-glass.

12. A line according to claim 1, wherein said core comprises three of said strands twisted together.

13. A line according to claim 1, wherein said core comprises continuous filament glass fiber strands.

14. A flexible, elongated line comprising a core having a plurality of strands of glass fibers coated with vermiculite, and a jacket surrounding said core, said jacket being formed of filamentary members comprising interlaced glass fibers over which para-aramid fibers are spun.

15. A line according to claim 14, wherein said vermiculite comprises between 2 wt % and about 20 wt % of said strands.

16. A line according to claim 14, wherein said filamentary members comprise between about 46 wt % and about 66 wt % glass fiber.

17. A flexible, elongated line usable to define a path through a region of intense heat, said line comprising a continuous, flexible, non-flammable inner core formed of carbon fiber strands, and an outer abrasion and cut resistant jacket substantially surrounding said inner core.

18. A line according to claim 2, wherein said core comprises a plurality of said carbon fiber strands twisted together.

* * * * *

UNITED STATES PATENT AND TRADEMARK OFFICE

CERTIFICATE OF CORRECTION

PATENT NO. : 7,175,908 B2
APPLICATION NO. : 10/877399
DATED : February 13, 2007
INVENTOR(S) : Connolly, Jr.

It is certified that error appears in the above-identified patent and that said Letters Patent is hereby corrected as shown below:

Column 4, line 47: Claim 18 should depend upon Claim 21, not Claim 2.

Signed and Sealed this

Tenth Day of April, 2007

JON W. DUDAS
*Director of the United States Patent and Trademark Office*